US009463128B2

(12) United States Patent
Ng

(10) Patent No.: US 9,463,128 B2
(45) Date of Patent: Oct. 11, 2016

(54) LIFT SYSTEM WITH STATUS INDICATORS

(71) Applicant: Liko Research & Development AB, Lulea (SE)

(72) Inventor: Chun-Piaw Ng, Singapore (SG)

(73) Assignee: Liko Research & Development AB, Lulea (SE)

( * ) Notice: Subject to any disclaimer, the term of this patent is extended or adjusted under 35 U.S.C. 154(b) by 0 days.

(21) Appl. No.: 13/666,198

(22) Filed: Nov. 1, 2012

(65) Prior Publication Data

US 2014/0115778 A1 May 1, 2014

(51) Int. Cl.
*A61G 7/10* (2006.01)
*G08B 5/00* (2006.01)

(52) U.S. Cl.
CPC ..... *A61G 7/1051* (2013.01); *A61G 7/1015* (2013.01); *A61G 7/1042* (2013.01); *A61G 7/1061* (2013.01); *A61G 7/1065* (2013.01); *G08B 5/00* (2013.01); *A61G 2203/32* (2013.01); *A61G 2205/60* (2013.01)

(58) Field of Classification Search
CPC ..... A61G 7/1049; A61G 7/1051; A61G 7/1053; A61G 7/1063; A61G 7/1065; A61G 7/1015; A61G 7/1042; A61G 7/1061; A61G 2203/32; A61G 2205/60
USPC ..... 5/83.1, 610, 611, 87.1, 89.1, 81.1 R
See application file for complete search history.

(56) References Cited

U.S. PATENT DOCUMENTS 4,944,056 A * 7/1990 Schroeder ..... A61G 7/1015 5/85.1
5,560,054 A 10/1996 Simon
5,682,630 A 11/1997 Simon
5,809,591 A * 9/1998 Capaldi et al. ..... 5/83.1
8,272,084 B2 * 9/2012 Spidare et al. ..... 5/83.1
2009/0102667 A1 * 4/2009 Rees ..... A61G 7/018 340/573.1
2009/0223434 A1 * 9/2009 Zorn ..... 116/226
2009/0307840 A1 * 12/2009 Lingegard ..... 5/83.1
2010/0005585 A1 * 1/2010 Spidare et al. ..... 5/83.1
2010/0097181 A1 * 4/2010 Sorensen ..... A61G 7/10 340/10.1
2011/0097187 A1 * 4/2011 Kelley et al. ..... 414/814
2012/0047655 A1 * 3/2012 O'Keefe ..... 5/610
2013/0019401 A1 * 1/2013 Faucher ..... A61G 7/1015 5/85.1
2013/0076517 A1 * 3/2013 Penninger et al. ..... 5/81.1 R
2014/0013503 A1 * 1/2014 Dixon ..... A61G 7/1073 5/85.1

FOREIGN PATENT DOCUMENTS

GB 2427057 A 12/2006
WO 2008007222 A2 1/2008

OTHER PUBLICATIONS

European Search Report for EP Application 13190831.1; Mailed Jan. 15, 2015; Received Jan. 19, 2015; Place of Search—The Hague; Date of completion of the search—Jan. 7, 2015.

(Continued)

*Primary Examiner* — Nicholas Polito
(74) *Attorney, Agent, or Firm* — Kenneth C. Baran

(57) ABSTRACT

A lift apparatus for lifting a patient comprises a sling bar (60) adapted to have a sling (110) secured thereto, a controller (138) and a status indicator (160) responsive to the controller for indicating the status of at least one parameter associated with the lift apparatus. The associated parameters comprise height, speed, sling securement state, sling compatibility, and fault state.

12 Claims, 9 Drawing Sheets

(56) References Cited

OTHER PUBLICATIONS

Communication Pursuant to Article 94(3) EPC, EP Application 13190831.1; mailed Oct. 14, 2015.
European Search Report; EP Application 15177533.5; Mailed Oct. 16, 2015; Place of Search—The Hague; Date of Completion of the Search—Oct. 8, 2015.
Response sent to EPO on Jul. 20, 2015 for European Search Report for EP Application 13190831.1.
Amended pages (final) sent to EPO on Jul. 20, 2015 for European Search Report for EP Application 13190831.1.
Amended pages (tracked) sent to EPO on Jul. 20, 2015 for European Search Report for EP Application 13190831.1.
Claims (Final) sent to EPO on Jul. 20, 2015 for European Search Report for EP Application 13190831.1.
Claims (Tracked) sent to EPO on Jul. 20, 2015 for European Search Report for EP Application 13190831.1.
Response dated Mar. 7, 2016 to Communication Pursuant to Article 94(3) EPC, EP Application 13190831.1; mailed Oct. 14, 2015.
Response dated Jun. 7, 2016 to European Search Report, mailed Oct. 14, 2015; EP Application 15177533.5.
Amended Pages (Final)—EP Application 15177533.5.
Amended Pages (Tracked)—EP Application 15177533.5.
Claims (Final)—EP Application 15177533.5.
Claims (Tracked)—EP Application 15177533.5.
Communication pursuant to Article 94(3) EPC for EP Application 13190831.1; Mailed Jul. 7, 2016.

* cited by examiner

SLING HEIGHT INDICATIONS

| CRITERION | DECISION | COLOR |
|---|---|---|
| $h_1 \leq H_F \leq h_2$ | SATISFACTORY | GREEN |
| $h_2 < H_F \leq h_3$ | UNDESIRABLE | AMBER |
| $H_F > h_3$ | UNSATISFACTORY | RED |

SLING ATTACHMENT INDICATIONS

| ← CRITERIA → | | | |
|---|---|---|---|
| SLING | SLING ATTACHMENT | DECISION | COLOR |
| CORRECT | PROPER | SATISFACTORY | GREEN |
| CORRECT | IMPROPER | UNSATISFACTORY | RED |
| INCORRECT | PROPER | UNDESIRABLE | AMBER |
| INCORRECT | IMPROPER | UNSATISFACTORY | RED OR RED AND AMBER |

FIG. 9

LIFT SYSTEM WITH STATUS INDICATORS

TECHNICAL FIELD

The subject matter described herein relates to lifts of the type used in hospitals and other facilities to move patients from place to place, and particularly to a lift having status indicators for indicating the acceptability of lift related parameters.

BACKGROUND

Lift systems are used in hospitals, other health care facilities, and sometimes in home care settings to move a patient from one location to another or to assist the patient in moving. One type of lift system includes a lift motor unit translatably mounted on a rail that extends along the ceiling of the room. The components of the lift motor unit include a motor operably connected to a strap or tether that extends vertically downwardly from the lift motor unit. The lift system also includes a sling bar attached to the end of the tether remote from the motor. The lift system also includes a sling. To use the lift system a caregiver secures a patient in the sling, attaches the sling to the sling bar, and uses a control device to operate the motor to lift the patient to a higher elevation or lower the patient to a lower elevation. In one typical example the caregiver operates the motor to raise the patient off a bed, pulls on the sling to cause the motor unit to translate along the rail until the patient is positioned over a desired destination location, and then operates the motor again to lower the patient to the destination.

Despite the merits and advantages of existing lift systems, manufacturers continue to develop improvements such as those described herein.

SUMMARY

A lift apparatus for lifting a patient comprises a sling bar adapted to have a sling secured thereto, a controller and a status indicator responsive to the controller for indicating the status of at least one parameter associated with the lift apparatus. The associated parameters comprise height, speed, sling securement state, sling compatibility, and fault state.

BRIEF DESCRIPTION OF THE DRAWINGS

The foregoing and other features of the various embodiments of the lift system described herein will become more apparent from the following detailed description and the accompanying drawings in which:

FIG. 9 is a decision matrix related to another of the algorithms of FIG. 6.

DETAILED DESCRIPTION

Figure 1:
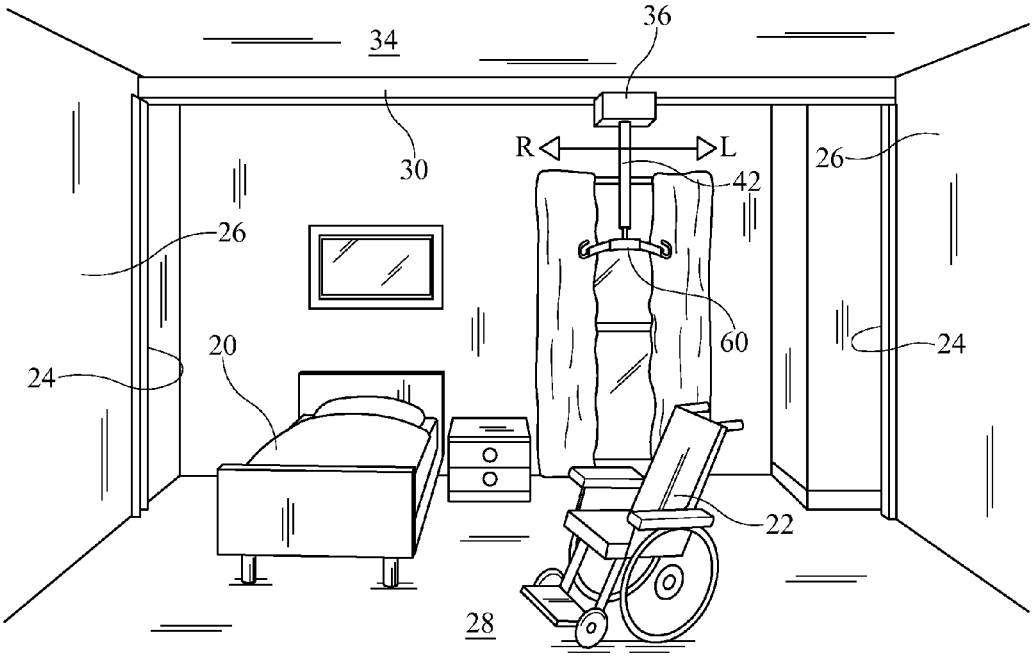
FIG. 1 is a perspective view of a room in a health care facility showing, among other things, a lift system for transferring patients from a source location to a destination location.
Figure 1A:
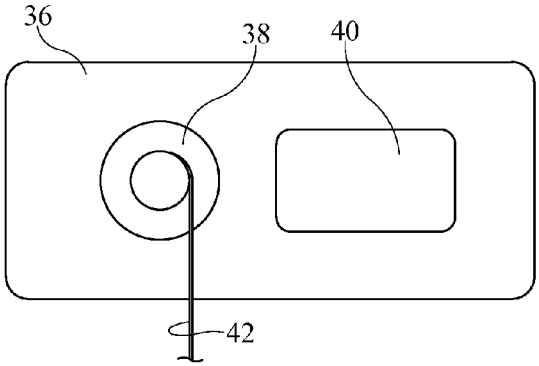
FIG. 1A is a schematic view of a lift motor unit showing a lift motor and a lift motor control unit.

FIGS. 1 and 1A show one example of a lift system of the type used in hospitals, other health care facilities and home care settings for transferring patients from a source location, for example a bed 20, to a destination location such as a wheelchair 22. The lift system includes a pair of stanchions 24 affixed to opposite walls 26 of a room. The stanchions extend vertically from floor 28 to a stationary rail 30 that extends laterally across the room between the stanchions and along the ceiling 34 of the room. A lift motor unit 36 engages the rail and is translatable along the rail in left and right lateral directions as indicated by the arrows labelled L and R (the left and right directions are based on the perspective of a supine occupant of bed 20). As seen best in FIG. 1A the lift motor unit includes a lift motor 38 and a lift motor control unit 40 (also referred to as a lift motor control box). A strap or tether 42 extends vertically downwardly from the lift motor unit. Operation of the lift motor in response to a user command causes the tether to retract into the lift motor unit or deploy from (i.e. extend out of) the lift motor unit.

Figure 2:
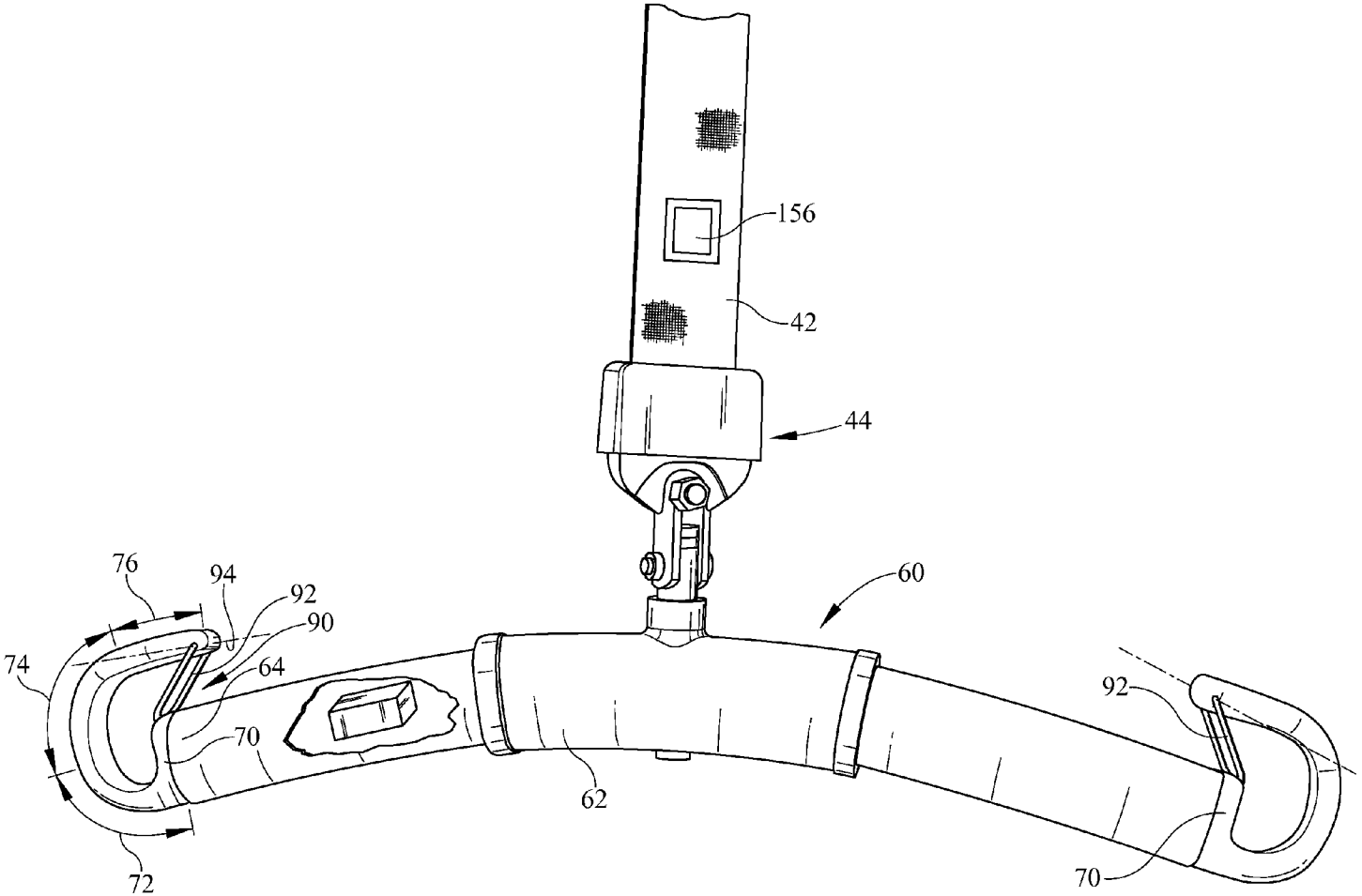
FIG. 2 is a view of a sling bar for the lift system of FIG. 1.
Figure 3:
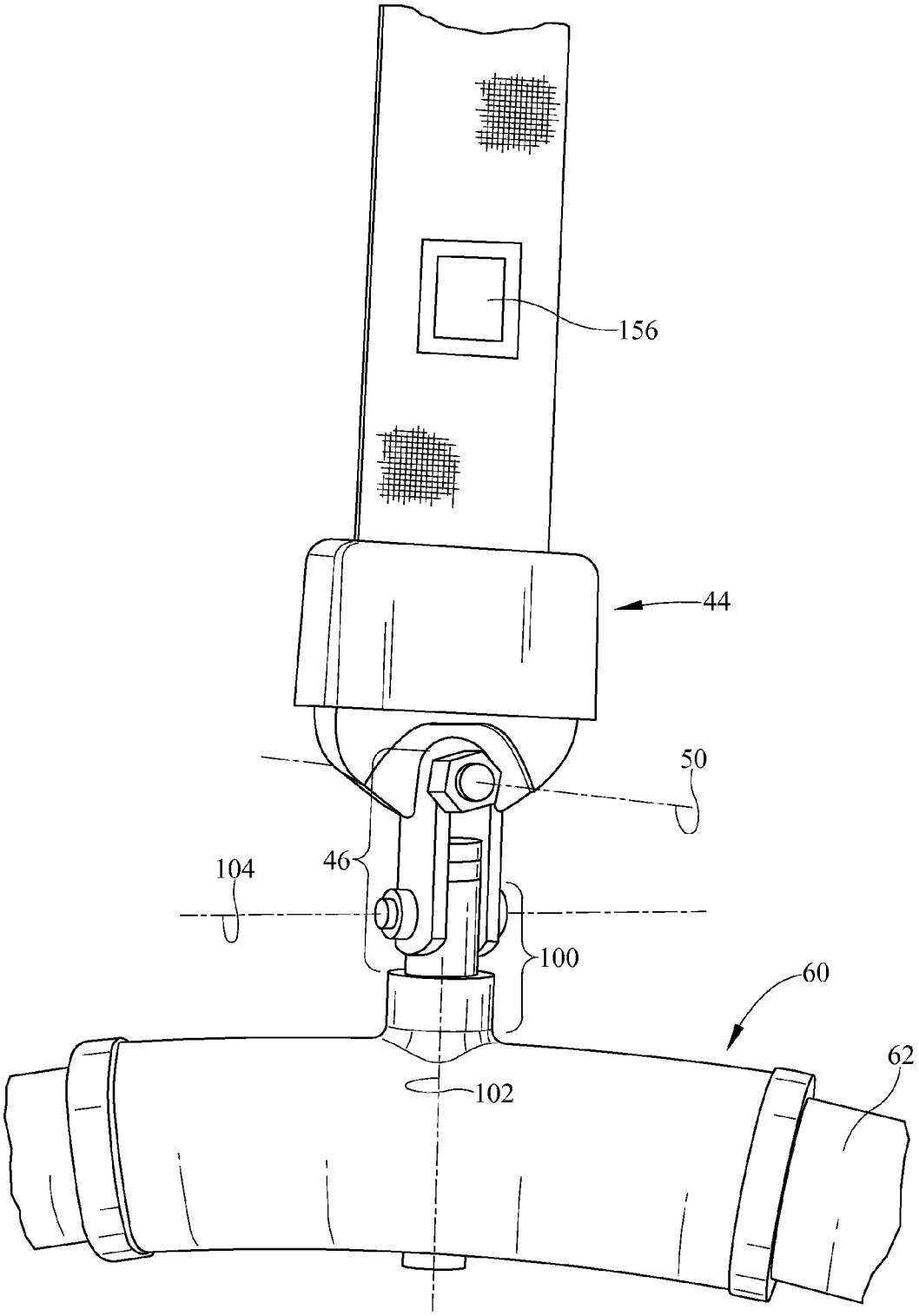
FIG. 3 is a closer view of a coupling between the sling bar and a tether.
Figure 4:
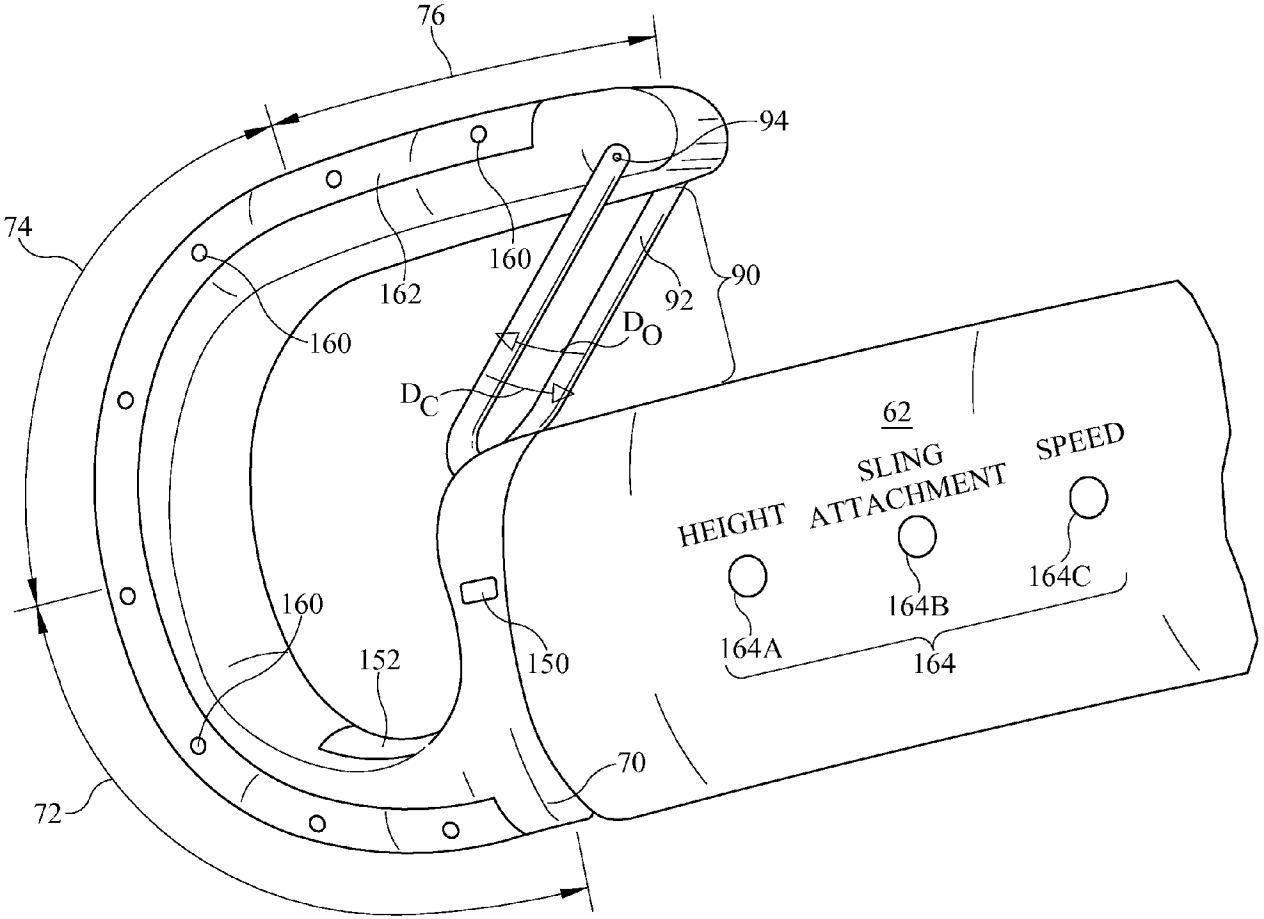
FIG. 4 is a closer view of a hook on one end of the sling bar.

Referring additionally to FIGS. 2-4, an attachment fixture 44 is secured to the lower end of the tether. A female connector 46 is pivotably secured to fixture 44 so that the connector is pivotable about female connector axis 50.

The lift system also includes a sling bar 60 which includes a beam 62 and a hook 64 at each end of the beam. Each hook has a base 70, a lower elbow 72, an upper elbow 74 and a terminus 76. The terminus 76 of each hook 64 is spaced from beam 62 to define a gap or space 90. A retainer 92 is pivotably secured to the terminus of each hook so that each retainer is pivotable or rotatable about a retainer axis 94, only one of which is shown in FIG. 2. Gravity causes the retainer to bridge across gap 90 from the terminus of the hook to the base of the hook where contact between retainer 92 and base 70 prevents further rotation of the retainer in direction $D_c$. The hook is therefore in a naturally closed state in which it has a perimeter defined by base 70, elbows 72, 74, terminus 76 and retainer 92. Each retainer can be easily rotated in direction $D_o$ to open the hook and allow an object to pass into the hook through space 90. However contact between retainer 92 and hook base 70 prevents the retainer from rotating in further in direction $D_c$ than is shown in the illustration in response to, for example, a force exerted on the retainer from within the hook perimeter. As a result the retainer prevents objects from passing out of the hook through space 90 unless the retainer has been first intentionally rotated in direction $D_o$.

The sling bar also includes a male connector 100 pivotably attached to beam 62 so that the beam can rotate about male pivot axis 102. Male connector 100 and female connector 46 are pivotably connected to each other for rotation about joint axis 104, which is perpendicular to female axis 50.

Figure 5:
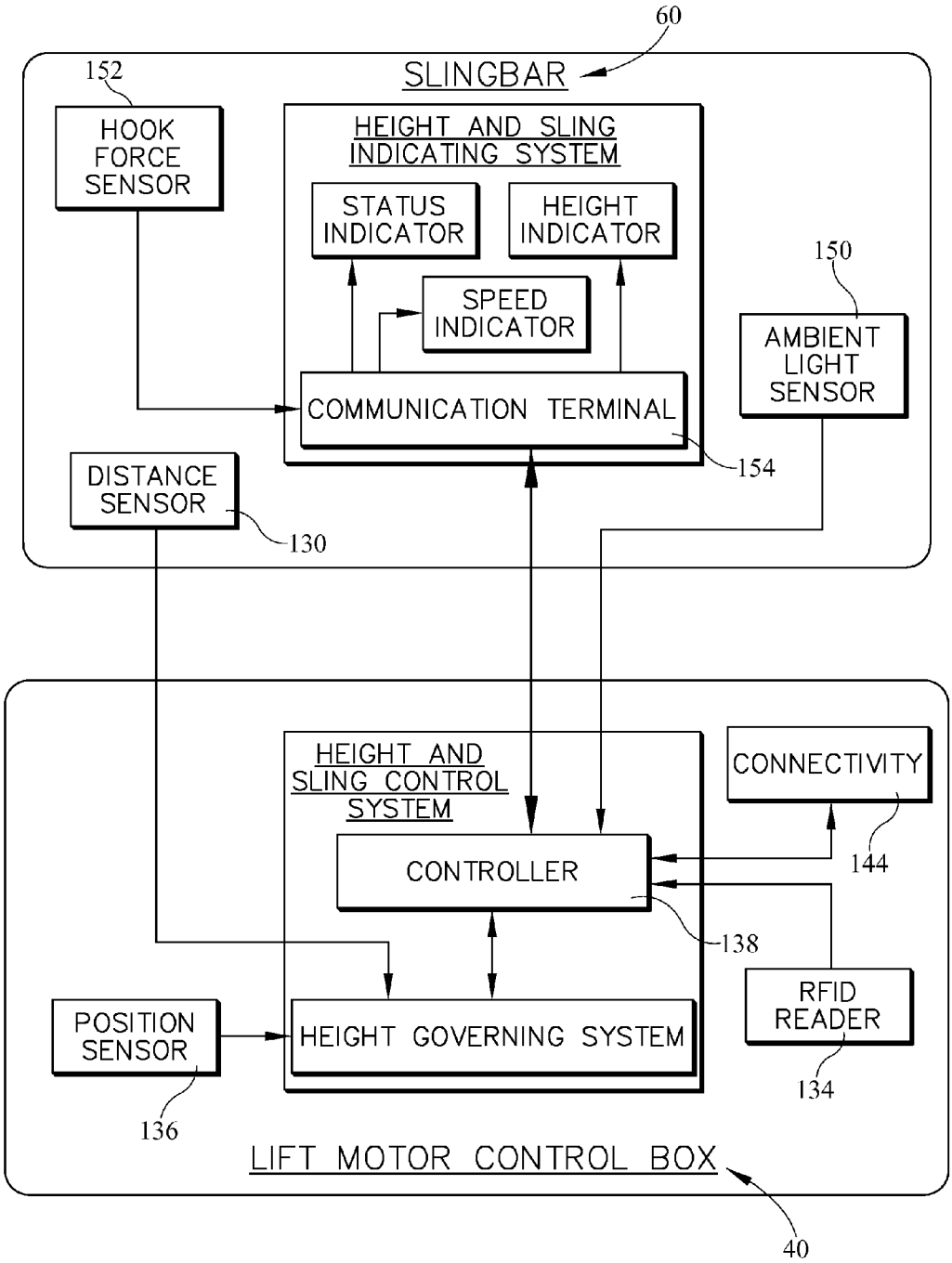
FIG. 5 is a schematic diagram showing selected components of the sling bar and the lift motor control unit

Referring additionally to FIG. 5, control unit 40 includes a position sensor 136 such as a potentiometer that provides a resistance-position relationship to enable detection of how much of tether 42 has been deployed from lift motor unit 36. Control unit 40 also includes an RFID reader 134, a controller 138 such as a microprocessor, and a height governing system 142. The height governing system 142 is configured to regulate the distance between sling bar 60 and the floor 28. The lift motor control unit also includes one or more connectivity modules 144 to facilitate communication with other devices and other networks such as a hospital communication network.

Sling bar 60 also includes an ambient light sensor such as photoresistor 150, and hook force sensors 152 for detecting the application of force to the lower elbows 72 of the sling bar hooks. An example of a suitable hook force sensor is a contact switch that includes an array of force sensing resistors. Such a hook force sensor is better suited to sensing the presence or absence of a force being exerted on the hooks rather than providing an accurate indication of the magnitude of the force. Sling bar 60 also includes a distance sensor 130 such as an ultrasonic transceiver. Sling bar 60 also includes a communication terminal 154. The sling bar communication terminal encapsulates information from the various sensors and provides the data to controller 138 by way of, for example, a serial data structure such as SPI. The controller processes this data and repackages it before transmission to connectivity modules 144 which can be Wifi, bluetooth, wired LAN or others. The communication terminal is a communication channel which operates under supervision of controller 138 which issues instructions to the terminal to start or stop communication. Suitable interface technologies for the communication terminal include Serial Peripheral Interfaces (SPI's), Universal Serial Bus (USB) interfaces, Parallel Peripheral Interfaces, TCP/IP interfaces, or other communication interfaces.

Figure 5A:
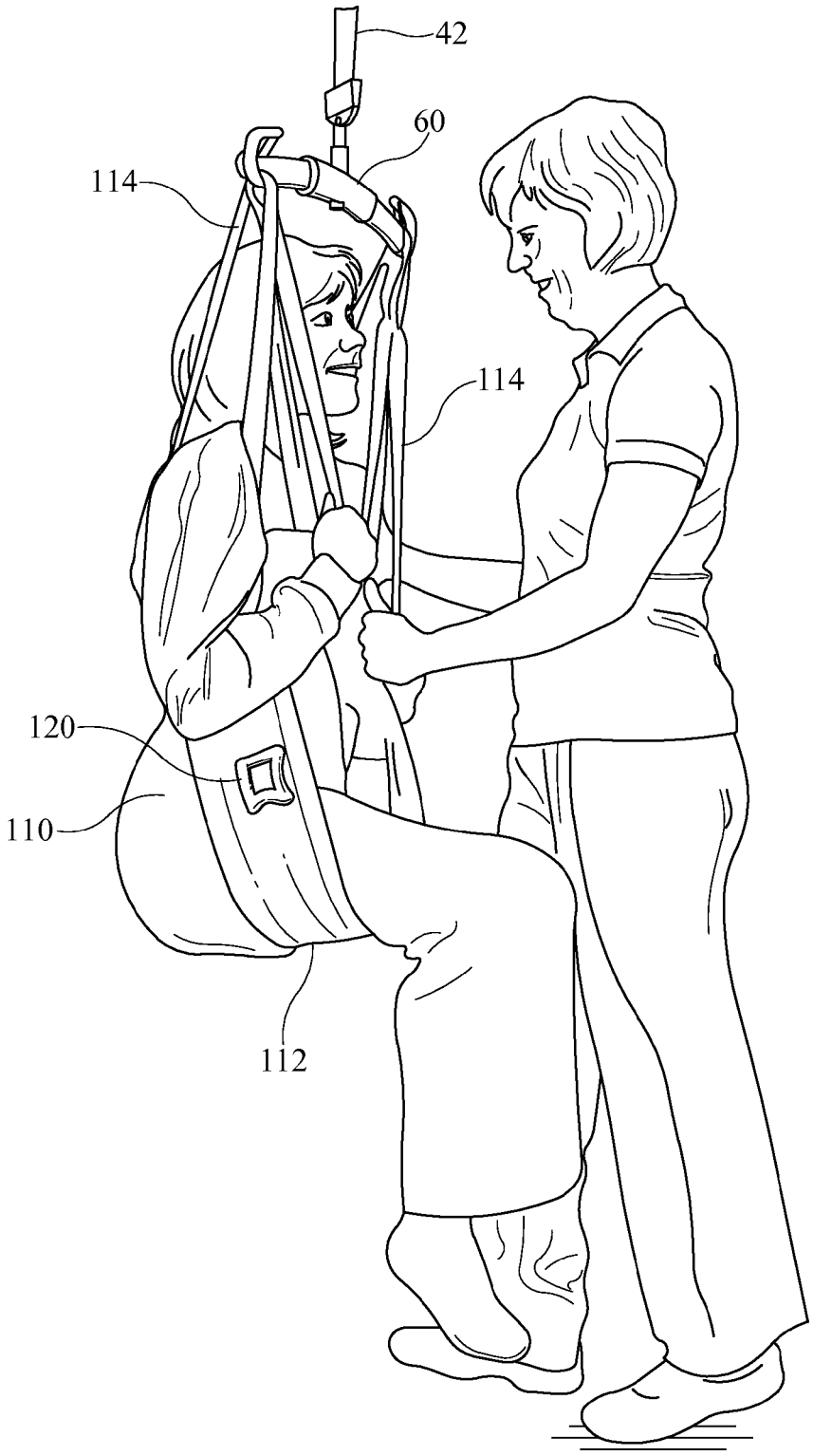
FIG. 5A is a view of a sling hooked onto the sling bar.
Figure 6:
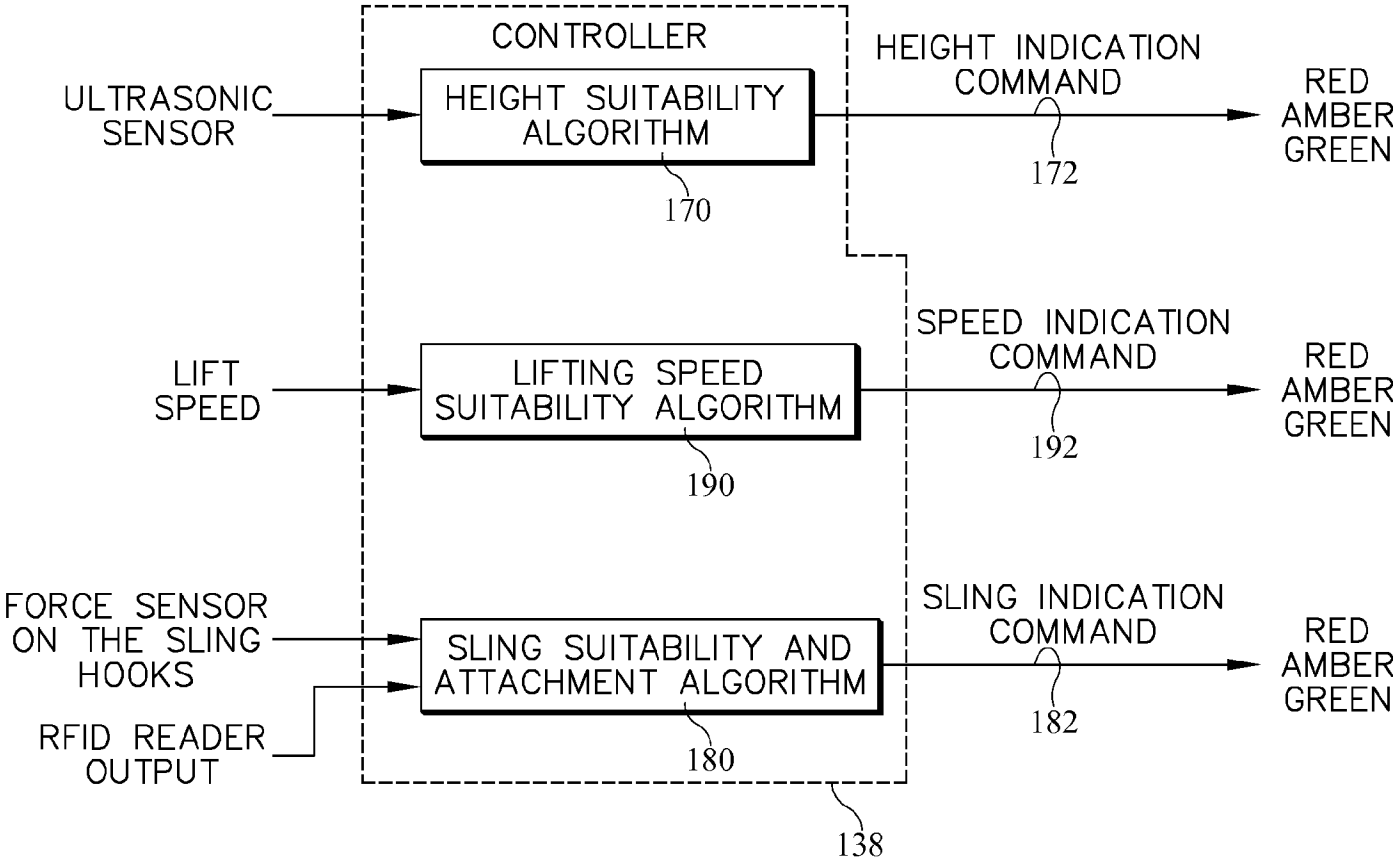
FIG. 6 is a block diagram showing the inputs and outputs of algorithms for producing indications related to the status of the lift system, in particular sling bar height, sling suitability and security, and lifting speed.

Referring additionally to FIG. 5A the lift system also includes a sling 110. The sling includes a seat portion 112 and straps 114 extending from the seat portion. Numerous models and styles of slings are commercially available, and not all slings are necessarily compatible with all sling bars and/or with all patients. The sling therefore includes an RFID tag 120 which, when interrogated by an RFID reader, reveals at least the model designation of the sling. The RFID tag may be programmable in which case the tag can be loaded with information concerning the identity of the patient assigned to the sling and/or any special requirements or restrictions related to the use of the sling with the patient.

Height governing system 142 governs the distance between the sling bar and the floor by monitoring the electric potential provided from position sensor 136 and the data from distance sensor 130. The position sensor (such as a potentiometer) provides distance information between the sling bar 60 and motor unit 36 by reading the number of revolutions of motor 38, which correlates to the distance between the sling bar and the motor unit. The distance sensor 130 provides distance information between the sling bar and the floor. It is expected that the information collected from the position sensor and the distance sensor would correlate with each other. In other words, referring to FIG. 8, the distance $H_F$ between the sling bar and the floor as determined from distance sensor 130, plus distance $H_c$ between the sling bar and the ceiling determined from position sensor 136 should equal the known height H of the ceiling relative to the floor. If not there is a possible fault in the system, for example in the system electronics or the calibration of position sensor 136, which the system can report.

The height governing system 142 receives raw data from the position and distance sensors and puts it in a prescribed format ready for transmission to controller 138. The controller receives information from the height governing system and from one or more other modules such as RFID reader 134, connectivity module 144, hook force sensor 152, tether force sensor 156 and ambient light sensor 150 and determines the timing of control signals to other peripherals (such as providing status indicators described below). The height governing system also includes current sensing circuitry to measure the electrical current delivered to motor 38 and voltage sensing circuitry to measure the motor voltage. The controller uses the data to calculate and provide the appropriate current drive for the motor.

The lift system also includes a tether force sensor 156 such as a load cell (FIGS. 2-3) that senses tension on the tether or force exerted through attachment fixture 44 and female and male connectors 46, 100. Although FIGS. 2-3 depict the sensor as being integrated into tether 42, it can also be integrated into attachment fixture 44, female connector 46, male connector 100 or some combination thereof. Suitable force sensors other than load cells may also be used. The tether force sensor is provided to give an accurate measurement of force exerted on the tether, specifically to give an indication of the amount of patient weight supported by the sling bar.

The tether force sensor 156 is used to determine patient weight. The hook force sensors 152 are used to sense the presence or absence of a load applied to hooks 64 and therefore to determine if a sling is properly attached, i.e. if sling straps 114 are securely captured on both hooks 64.

The sling bar hooks also include one or more sources of light such as light emitting diodes (LED's) 160. LED's 160 are status indication LED's that indicate the status of the lift system as described below in more detail. LED's 160 are mounted behind a lens 162 which wraps around the hook from base 70 to terminus 76. The lens protects the LED's from damage and may perform certain optical functions such as directing the light emitted from the LED's in one or more preferred directions. By way of examples, the light source may comprise a single LED which can emit light of at least three colors (e.g. red, amber, green), or may comprise multiple LED's each of which can emit light of at least three colors, or may comprise multiple LED's each of which emits light of only a single color but which collectively emit light of at least three colors. The sling bar also includes a second light source exemplified as a set of LED's 164 such as the three LED's 164A, 164B, 164C labelled "HEIGHT", "SLING ATTACHMENT" and "SPEED". The second set of LED's is an interpretive indicator so that a user understands how to interpret indications provided by LED's 160. The output of photoresistors 150 can be input to controller 138. The controller can then regulate the intensity of the light from the LED or LED's, as a function of light intensity in the room.

To use the system a caregiver secures a patient in the sling and attaches the sling to sling bar hooks 64 by passing sling straps 114 through sling bar openings 90. The caregiver may then use a control device, such as a touch screen or a hand-held remote control device, not shown, to operate the motor and lift the patient to a higher elevation or lower the patient to a lower elevation. In one typical example the caregiver operates the motor to raise the patient off the bed, then pulls on the sling to cause motor unit 36 to translate along rail 30 until the patient is positioned approximately above a wheelchair pre-positioned under the rail. The caregiver then operates the motor to lower the patient onto the wheelchair.

The components of the disclosed lift system cooperate to provide a number of status indications, specifically a sling height indication, a sling attachment indication and a lifting speed indication as described in the following paragraphs.

Figures 7, 8:
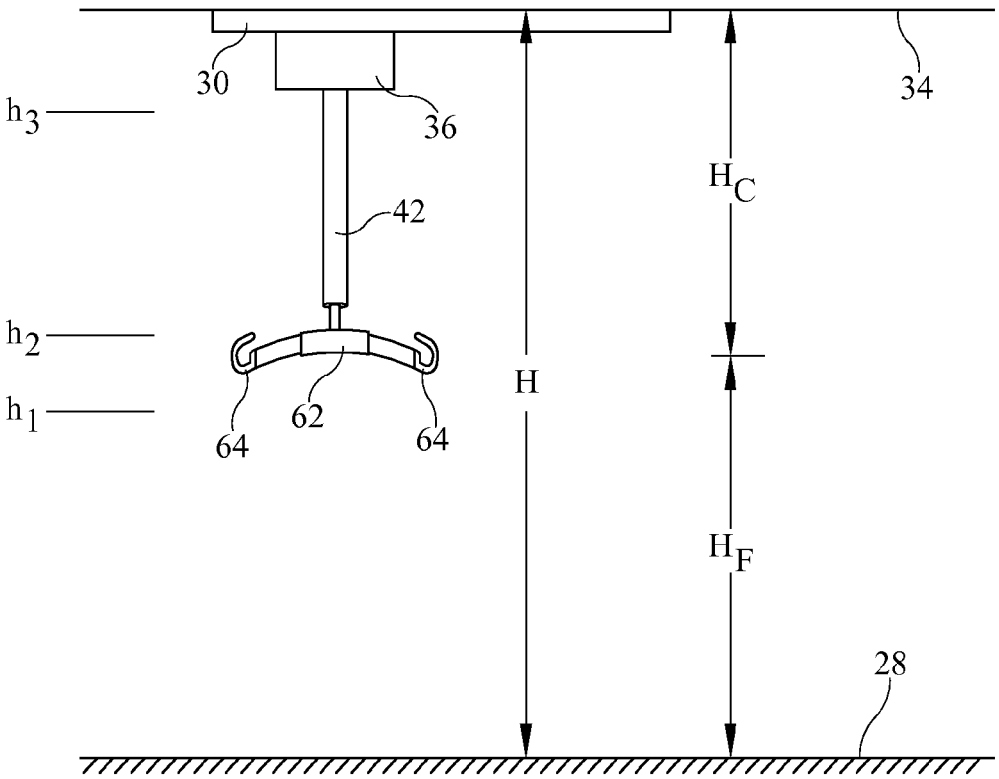
FIGS. 7-8 are a decision matrix related to one of the algorithms of FIG. 6 and a diagram defining parameters used in the decision matrix.

Sling Height Indication:

Referring principally to FIGS. 4, 5, and 6-8, ultrasonic transceiver 130 emits ultrasonic signals toward the floor of the room and measures the return signal reflected off the floor. Controller 138 processes the information from the ultrasonic transceiver to determine the height $H_F$ of the sling relative to the floor. Controller 138 executes an algorithm 170 to compare height $H_F$ to one or more height threshholds and, depending on the outcome of the determination, issues a height indication command 172 to command red, amber, or green illumination of LED's 160. FIGS. 7-8 show elements of an algorithm for making the determination. If the sling is at its lowest possible height plus or minus a tolerance (e.g. $h1=H_F \leq h2$) the controller issues a height indication command 172 to command green illumination of LED's 160 to signify that the height is satisfactory. If the sling is at an intermediate height (e.g. $h2<H_F \leq h3$) the controller commands amber illumination to signify that the height is undesirable. If the sling is at height higher than the upper end of the intermediate range (e.g. $H_F>h3$) the controller commands red illumination to signify that the height is unsatisfactory. If the controller commands amber or red illumination of LED's 160 the controller also commands illumination of LED 164A (FIG. 4) to signify that the amber or red indication relates to sling height.

In one possible enhancement of the sling height indication, a height reading that would otherwise cause a satisfactory (green) indication will instead cause an undesirable (yellow) or unsatisfactory (red) indication if the height reading persists for more than a prescribed period of time. Three possible alternatives are summarized in tables 1-3 below. Table 1 shows an alternative that specifies an undesirable or unsatisfactory indication, at the choice of the system designer, if the sling bar is at a height that would otherwise be satisfactory but is at that height for a time t longer than $t_A$.

TABLE 1

| Height | time | indication |
|---|---|---|
| $h1 \leq H_F \leq h2$ | $t > t_A$ | undesirable (amber) or unsatisfactory (red) at the discretion of the system designer |

Table 2 specifies an undesirable indication (amber) if the sling bar is at a height that would otherwise be satisfactory but is at that height for a time t at least as long as time $t_A$ but less than time $t_B$. Table 2 also specifies an unsatisfactory indication (red) if the sling bar is at a height that would otherwise be satisfactory but is at that height for a time t which is at least as long as time $t_B$.

TABLE 2

| Height | time | indication |
|---|---|---|
| $h1 \leq H_F \leq h2$ | $t_A \leq t < t_B$ | undesirable (amber) |
| $h1 \leq H_F \leq h2$ | $t \geq t_B$ | unsatisfactory (red) |

Table 3 specifies an unsatisfactory indication (red) if the sling bar is at a height that would otherwise be undesirable (amber) but is at that height for a time t which is greater than $t_A$.

TABLE 3

| Height | time | indication |
|---|---|---|
| $h2 < H_F \leq h3$ | $t > t_A$ | unsatisfactory (red) |

In another enhancement a satisfactory indication results from a sling bar height that would otherwise produce an amber or red indication if the load exerted on the sling bar as indicated by, for example, tether force sensor 156, is small enough to indicate that the sling bar is not supporting the weight of a patient.

Sling Attachment Indication:

Referring principally to FIGS. 4, 5, 6, and 9, RFID reader 134 interrogates the RFID tag 120 associated with a sling 110 brought into the vicinity of the lift system (i.e. so that the RFID tag attached to the sling is in range of the RFID reader). In addition hook force sensors 152 detect the application of force to the hooks. Controller 138 executes an algorithm 180 to processes the information from the RFID reader and hook force sensors to determine if the proper sling is attached properly or to facilitate such determination. For example if the sling is correct (as indicated by patient identifying data loaded onto the RFID tag of a patient-specific sling) and is properly attached to the sling bar (as indicated by at least a minimum force being exerted on each of the two hook force sensors 152) controller 138 issues a sling indication command 182 to command green illumination of LED's 160 to signify the correctness of the sling and its proper securement to the sling bar. FIG. 9 shows elements of an algorithm for making the determination. If the sling is correct but is improperly attached (e.g. less than a minimum force being exerted on at least one hook force sensor), controller 138 commands red illumination of the LED's to signify improper attachment of the correct sling. If the sling is incorrect but is properly attached, controller 138 commands amber illumination of the LED's to signify incorrectness of a properly attached sling. If the sling is incorrect and is improperly attached controller 138 commands either red illumination of the LED's or a combination of red and amber illumination. If the controller commands amber or red illumination of LED's 160 the controller also commands illumination of LED 164B to signify that the amber or red indication relates to sling height. Other relationships between LED illumination color and the sling and sling attachment suitability may be used instead of those in the table.

Lift Speed Indication

Referring to FIGS. 4, 5 and 10, controller 138 executes an algorithm 190 to determine the suitability of the lifting speed. The system governs lifting speed by commanding an appropriate amount of current to drive lift motor 38. Heavier loads (i.e. higher patient weight) require more current to maintain a given speed; lighter loads (i.e. lower patient weight) require less current to maintain a given speed. An example table of required voltage and nominal current as a function of patient weight is shown in table 4 below for the case of raising the sling bar, and therefore the patient, to a higher elevation. An example table of required voltage and current as a function of patient weight is shown in table 5 below for the case of lowering the sling bar, and therefore the patient, to a lower elevation. The tables also show the resulting speed and the approximate time required to cause the tether to extend or retract approximately 50 cm. The tables as presented are independent of strap length however tables for other strap lengths can be developed if it is determined that the current should also be a function of strap length.

TABLE 4

| Raising the Sling Bar | | | | |
|---|---|---|---|---|
| Weight while lifting up (kg) | Time taken (sec.) | Voltage (V) | Current (A) | Speed (cm/s) |
| 350 | 11.31 | 24 | 18 | 4.4 |
| 300 | 10.46 | 25 | 17 | 4.8 |
| 250 | 9.81 | 25 | 15 | 5.1 |
| 200 | 9.28 | 26 | 13 | 5.4 |
| 150 | 8.78 | 26 | 12 | 5.7 |
| 100 | 8.34 | 27 | 9 | 6 |
| 50 | 7.88 | 27 | 6.5 | 6.4 |
| 0 | 7.3 | 27 | 3.5 | 6.8 |

TABLE 5

| Lowering the Sling Bar | | | | |
|---|---|---|---|---|
| Weight while lifting down (kg) | Time taken (s) | Voltage (V) | Current (A) | Speed (cm/s) |
| 350 | 12.53 | 27 | 0 | 4 |
| 300 | 12.97 | 27 | 0 | 3.9 |
| 250 | 13.03 | 27 | 0.5 | 3.8 |
| 200 | 13.21 | 27 | 1 | 3.8 |
| 150 | 13.47 | 27 | 1.25 | 3.7 |
| 100 | 13.75 | 27 | 1.3 | 3.6 |
| 50 | 13.88 | 27 | 1.5 | 3.6 |
| 0 | 13.5 | 27 | 1.4 | 3.7 |

Electrical current sensing electronics in the height governing system senses the actual current and determines if the actual current is within a tolerance band (for example plus or minus 10%) of the nominal value. If the speed is within the specified tolerance the speed is satisfactory, and controller 138 issues a sling indication command 192 to command green illumination of the LED's. If the speed is outside the specified tolerance, controller 139 commands red illumination of the LED's to signify the unsatisfactory speed. Alternatively three tolerance bands could be defined—a satisfactory tolerance band within, say, plus or minus 10% of nominal (green), an undesirable band between plus or minus 10% and plus or minus 12% of nominal (amber), and an unsatisfactory band for speeds outside the plus or minus 12% band (red). If the controller commands amber or red illumination of LED's 160 the controller also commands illumination of LED 164C to signify that the amber or red indication relates to sling speed.

The controller also includes data validation algorithms to check for certain faults in the sensors or system electronics. For example load cells 156 may be faulty, or the conversion of the analog signal from the load cells to a digital signal suitable for the controller may be erroneous. In another example a timer in controller 138 may not be functioning properly. In another example a sensed value of a parameter, such as motor current and/or voltage, may differ from commanded values of the parameter. The existence of such faults causes the controller to command appropriate illumination of LED's 160 and 164. Table 6 below shows the commanded LED illumination as a function of whether or not patient weight, motor voltage and motor current comply with validation tests and whether or not the timer is determined to be functioning properly. The letter "X" in a table entry signifies that the parameter in the column heading is not taken into account in determining the LED illumination color. Faults or combinations of faults not shown in the table 6 will cause the controller to command red illumination.

TABLE 6

| | Weight Valid? | Timer Functioning Properly? | Voltage Valid? | Current Valid? | LED Illumination |
|---|---|---|---|---|---|
| 1 | YES | YES | YES | YES | Green |
| 2 | NO | YES | YES | YES | Amber |
| 3 | YES | NO | YES | YES | Amber |
| 4 | YES | YES | NO | YES | Amber |
| 5 | YES | YES | YES | NO | Amber |
| 6 | NO | NO | X | X | Red |
| 7 | X | NO | NO | X | Red |
| 8 | X | X | NO | NO | Red |
| 9 | X | X | X | NO | Red |

Faults or combinations of faults not shown in the table 7 will cause the controller to command red illumination.

An alternate data validation table is shown below in table 7 for a lift system that does not include a tether force sensor.

TABLE 7

| | Is distance ($H_c$) from motor to sling bar valid? | Timer Functioning Properly? | Voltage Valid? | Current Valid? | LED Illumination |
|---|---|---|---|---|---|
| 1 | YES | YES | YES | YES | Green |
| 2 | NO | YES | YES | YES | Amber |
| 3 | YES | NO | YES | YES | Amber |
| 4 | YES | YES | NO | YES | Amber |
| 5 | YES | YES | YES | NO | Amber |
| 6 | NO | NO | YES | X | Red |
| 7 | X | NO | NO | X | Red |
| 8 | X | X | NO | NO | Red |
| 9 | X | X | X | NO | Red |

If desired, LED's 160 can be arranged to shine on the floor of the room. As a result, a caregiver whose view of the LED's is blocked still has an opportunity to be informed of the status of sling height, lifting speed and sling suitability and attachment and also any fault indications.

The output from indication commands 172, 182, 192 or other output from algorithms 170, 180, 190 can be provided to a facility information network by way of connectivity module or modules 144. The information can be used for a number of purposes such as to update care records or to apprise a remote caregiver of an undesirable or unsatisfactory condition. Similarly, information can be conveyed from the information network to components of the system, such as RFID reader 134 to customize the RFID reader to be compatible with information on RFID tag 120.

I claim:

1. A lift apparatus for lifting a patient comprising:

a sling bar adapted to have a sling secured thereto, the apparatus including a controller and a status indicator responsive to the controller for indicating the status of at least two parameters associated with the lift apparatus, the apparatus also including an interpretive indicator for indicating which of the parameters the status indicator is referring to, wherein the status indicator indicates a satisfactory status and also indicates at least one of an undesirable status and an unsatisfactory status and wherein a height status is indicated by the status indicator as set forth below:

| Height Criterion or Reading | Indication |
|---|---|
| $h1 < HF \leq h2$ | Satisfactory |
| $h2 < HF \leq h3$ | Undesirable |
| $HF > h3$ | Unsatisfactory |

where h1, h2 and h3 are threshold heights relative to a reference height such that h3>h2>h1 and h1 is greater than the reference height and where HF is height of the sling bar relative to the reference height.

2. The lift apparatus of claim 1 wherein the height reading $h1<HF\leq h2$ causes a status indication other than satisfactory if the height reading persists for more than a prescribed period of time.

3. The lift apparatus of claim 2 wherein the other than satisfactory indication is an undesirable or unsatisfactory indication.

4. The lift apparatus of claim 2 wherein the other than satisfactory indication is an indication as set forth in the table below:

| Height Criterion or Reading | time | indication |
|---|---|---|
| $h1 \leq H_F \leq h2$ | $t_A \leq t < t_B$ | undesirable |
| $h1 \leq H_F \leq h2$ | $t \geq t_B$ | unsatisfactory |

where t is time and tA and tB are time limits such that tB>tA.

5. The lift apparatus of claim 2 wherein the other than satisfactory indication is an indication as set forth in the table below:

| Height Criterion or Reading | time | status indication |
|---|---|---|
| $h2 < H_F \leq h3$ | $t > t_A$ | unsatisfactory |

where t is time and to is a time limit.

6. The lift apparatus of claim 1 wherein the status indicator indicates a sling status depending on sling correctness and sling attachment state as set forth below:

| Sling | Sling Attachment Status | Status Indication |
|---|---|---|
| Correct | Proper | Satisfactory |
| Correct | Improper | Unsatisfactory |
| Incorrect | Proper | Undesirable |
| Incorrect | Improper | Unsatisfactory |

where "correct" signifies that a sling is compatible with the sling bar and/or a patient and "incorrect" signifies that the sling is incompatible with the sling bar and/or a patient and wherein "proper" signifies that the sling is properly attached to the sling bar and "improper" signifies that the sling is not properly attached to the sling bar.

7. The lift apparatus of claim 6 comprising an RFID reader that communicates with an RFID tag associated with a sling to support a determination of sling correctness or incorrectness.

8. The lift apparatus of claim 6 wherein the sling bar includes a hook and a force sensor adapted to perceive presence or absence of a force being exerted on the hooks to support a determination of proper or improper sling attachment to the sling bar.

9. The lift apparatus of claim 1 wherein the status indicator indicates the status of only one of the at least two parameters at a time.

10. The lift apparatus of claim 1 wherein the associated parameters comprise height, speed, sling securement state, sling compatibility, and fault state.

11. A lift apparatus for lifting a patient comprising:

a sling bar adapted to have a sling secured thereto, the apparatus including a controller and a status indicator responsive to the controller for indicating the status of at least two parameters associated with the lift apparatus, the apparatus also including an interpretive indicator for indicating which of the parameters the status indicator is referring to and wherein the status indicator indicates a satisfactory status and also indicates at least one of an undesirable status and an unsatisfactory status and wherein the status indicator indicates a lifting speed status such that:

if speed of the sling is within a first specified tolerance the indication is satisfactory;

if speed of the sling is outside the first specified tolerance but within a second specified tolerance the indication is undesirable; and if speed of the sling is outside the second specified tolerance the indication is unsatisfactory.

12. The lift apparatus of claim 11 wherein the sling bar is raised and lowered with an electric motor and wherein electrical current drawn by the motor is used to determine speed of the sling.

* * * * *